US005671321A

United States Patent [19]

Bagnuolo

[11] Patent Number: 5,671,321

[45] Date of Patent: Sep. 23, 1997

[54] AIR HEATER GUN FOR JOINT COMPOUND WITH FAN-SHAPED ATTACHMENT

[76] Inventor: Donald J. Bagnuolo, 115 Elliott Pl., Rutherford, N.J. 07070

[21] Appl. No.: 637,050

[22] Filed: Apr. 24, 1996

[51] Int. Cl.[6] ..... A45D 20/10

[52] U.S. Cl. ..... 392/385; 392/367; 392/379; 392/383; 34/96

[58] Field of Search ..... 392/379–385, 392/363, 367; 34/90, 91, 96–101, 283; 156/579, 499; 239/553.5, 566, 548, 499, 498, 502, 556–557

[56] References Cited

U.S. PATENT DOCUMENTS

| | | | |
|---|---|---|---|
| 260,746 | 7/1882 | Denny | 239/566 |
| 469,211 | 2/1892 | Kline | 239/553.5 |
| 752,803 | 2/1904 | Ross | 239/553.5 |
| 1,777,744 | 10/1930 | Breuer . | |
| 2,096,023 | 10/1937 | Albertson | 392/383 |
| 2,114,494 | 4/1938 | Hummel et al. | 392/384 |
| 2,385,121 | 9/1945 | Williams . | |
| 2,834,866 | 5/1958 | Bentzman . | |
| 2,998,924 | 9/1961 | Schaeffer | 239/566 |
| 3,094,606 | 6/1963 | Ferris | 392/385 |
| 3,115,567 | 12/1963 | Meltzer . | |
| 3,297,601 | 1/1967 | Maynard et al. . | |
| 3,418,452 | 12/1968 | Grabner . | |
| 3,668,370 | 6/1972 | Pattison . | |
| 3,837,581 | 9/1974 | Orsoff | 34/97 |
| 4,097,722 | 6/1978 | Soler et al. . | |
| 4,230,279 | 10/1980 | Forsberg | 239/559 |
| 4,287,673 | 9/1981 | Wolter | 34/97 |
| 4,454,267 | 6/1984 | Williams . | |
| 4,538,362 | 9/1985 | Andis | 34/97 |
| 4,551,615 | 11/1985 | Wilson . | |
| 4,602,146 | 7/1986 | Barns et al. | 392/384 |
| 4,657,594 | 4/1987 | Struss . | |
| 4,683,370 | 7/1987 | Petersen et al. . | |
| 4,686,253 | 8/1987 | Struss et al. . | |
| 4,692,594 | 9/1987 | Martin | 392/383 |
| 4,848,007 | 7/1989 | Montagnino | 34/97 |
| 4,967,060 | 10/1990 | Lomeli | 392/384 |
| 5,157,757 | 10/1992 | McDougall . | |
| 5,235,759 | 8/1993 | Rizzuto, Jr. | 34/97 |
| 5,275,339 | 1/1994 | Andis et al. | 239/443 |

FOREIGN PATENT DOCUMENTS

| | | | |
|---|---|---|---|
| 348332 | 4/1905 | France | 239/566 |
| 401506 | 9/1924 | Germany | 239/502 |
| 2961 | of 1885 | United Kingdom | 239/566 |
| 380524 | 9/1932 | United Kingdom | 239/556 |

*Primary Examiner*—Tu B. Hoang

[57] ABSTRACT

A heat gun quickly and efficiently dries joint compound. The heat gun includes an outer shroud defining an airflow chamber and a fan which drives airflow therethrough. A motor provides drive to the fan while a plurality of heating coils disposed within the airflow chamber heat the airflow between 1200 and 1700 ° Fahrenheit. A fan-shaped attachment is attached about an endcap of the heat gun. The fan-shaped attachment extends into a pair of sidewall surfaces terminating in an elongated port. The elongated port is preferably between ½ and 3 inches in diameter and between 8 and 12 inches in length. The endcap of the heat gun is between 1 and 3 inches in diameter. A plurality of ribs connect the pair of sidewall surfaces and extend longitudinally from the endcap of the heat gun to the elongated port of the fan-shaped attachment to define a plurality of longitudinal air passages which evenly distribute airflow along the fan-shaped attachment. Each of a portion of the ribs includes an air stop at an end proximal to the endcap such that air flow is restricted along a portion of the air passages to promote even airflow distribution.

20 Claims, 2 Drawing Sheets

AIR HEATER GUN FOR JOINT COMPOUND WITH FAN-SHAPED ATTACHMENT

BACKGROUND OF THE INVENTION

1. Field of the Invention

The present invention relates to the art of hand held hot air blowing devices. More particularly, the present invention relates to hot air blowing devices having a fan-shaped tip for drying joint compound.

2. Description of the Related Art

In the construction of interior building walls and ceilings, gypsum wall board or "drywall" is often used. Drywall itself is made by enclosing a calcined gypsum water mix between a pair of paper layers. After the core has set and dried, the board is ready for use. Drywall panels may be formed in varying sizes and are often sold as planar sheets which are four feet wide by twelve feet in length.

Walls made from gypsum wallboard are conventionally constructed by affixing wallboard panels to studs or joists. The joints between adjacent panels are then filled and coated with a specially prepared adhesive typically called "joint compound."

During interior construction, a first layer of joint compound is applied between the wallboard joints. Next, a liquid-permeable fiberglass tape is embedded into the joint compound. When dry or "set," a second coating of joint compound is applied over the joint. After drying, the second layer may be lightly sanded and a third layer applied. The third layer is then sanded and the joint is then painted.

Joint compound is also used to fill screw divots which are created as drywall screws are drilled through the drywall and into the building structure. Joint compound may also be used to repair minor imperfections in the wallboard itself.

Joint compound is a special type of compound and the subject of numerous patents. For example, U.S. Pat. No. 4,468,253 sets forth a lightweight drying-type joint compound which may be used in building construction. Drying-type joint compounds become hardened through evaporation of water within the joint compound. A second, less popular, form of joint compound is the setting-type. An example of a setting-type joint compound may be found in U.S. Pat. No. 3,297,601.

While particular formulations of joint compound are very unique, all joint compounds include a number of common ingredients. A first ingredient is a filler such as calcium sulfate dihydrate. Other fillers are mica, talc, pyrophylite, sericite, and different clays such as kaolinite. Another required ingredient is a non-leveling agent such as attapulgus clay or mixtures of amylopectin starch with modified clays. Non-leveling agents have the ability to absorb large quantities of water and to expand to several times their normal volume. Other ingredients of joint compound include a thickener such as hydroxypropyl methylcellulose and a binder such as polyvinyl alcohol, ethylene vinyl acetate co-polymer, or starch. Another required ingredient is a wetting agent such as water.

Joint compound is typically grey in color when wet and becomes white upon drying. The color of joint compound is generally unimportant because joint compound is usually painted over with the drywall. Joint compound is applied in varying thicknesses depending upon the application or specific use. For example, a corner bead (the joining of two pieces of drywall in a corner) is applied thickly. In contrast, joint compound is applied much more thinly to a wall joint. Joint compound is applied with a joint compound knife which varies from six to ten inches in length. A hawk tool is used by the craftsman to hold the joint compound before application to a construction surface.

Once joint compound is applied to a construction surface or drywall seam, it is allowed to dry. Joint compound dries based upon a number of factors, most importantly the temperature of the room, the surrounding humidity, and the thickness of the application. Under normal conditions, one coat dries in six to eight hours such that one coat is applied per day. This is frustrating to the craftsman because three coats of joint compound are required on average to smoothly and seamlessly bond a joint between two pieces of drywall. The same holds true for a corner bead.

After application of the first layer of joint compound, the first layer is commonly subjected to very quick, "rough" sanding for the purpose of smoothing rough edges of the joint compound. A special tool such as a joint compound sanding block is wrapped with drywall sandpaper and then applied to the dried joint compound. Drywall sandpaper is provided in a number of varying grades.

Primer is generally applied to seal the joint compound and the drywall. Before application of the primer, the joint compound must be thoroughly dried. If primer is used, paint will not be absorbed into the drywall or joint compound.

Joint compound is a special application compound and is almost exclusively applied to drywall. Joint compound is seldom applied to brick, masonry or stone. These types of building materials require a cement or mortar.

Joint compound requires a special mixture of temperature and air pressure to dry properly. While a number of hand held heat guns are currently available, conventional hand held heat guns fail to address the specific needs required for quickly drying joint compound. If joint compound is subjected to a mild heat or a relatively low velocity air flow, drying time is not significantly decreased. On the other hand, too high a temperature would pose a potential fire hazard or potentially cause damage to the paper face of the underlying drywall.

A first type of conventional hand held heat gun is the hand held hair dryer. A hair dryer provides a relatively low level of heat output and a relatively low velocity of air. This is because a hair dryer is designed for direct application to the human body. As a further matter, a hair dryer does not have the power and high temperature required for drying joint compound beneath the surface of an applied layer. While hair dryers routinely incorporate a number of attachments, the attachments are generally adapted to perform a styling function for human hair and may not be readily adapted for drying joint compound.

A number of commercial paint strippers are also currently available. However, commercially available paint strippers are also generally inadequate for drying joint compound because of reduced heat output and reduced air output. For example, conventional paint strippers output air at approximately 750° to 1000° Fahrenheit. This is less than optimal. As a further matter, commercially paint strippers do not provide a number of attachments for effectively drying joint compound after application to a drywall seam.

SUMMARY OF THE INVENTION

It is a primary object of the present invention to address the problems in the prior art.

It is another object of the present invention to provide a hand held heat gun and attachment which may quickly and efficiently increase the drying speed of joint compound without posing a potential fire hazard or potentially cause damage to the paper face of the underlying drywall.

It is a further object of the invention to provide an attachment for a heat gun which will not gouge wet drywall and will promote the efficient dispersion of air along a joint compound seam.

Objects of the invention are achieved by a heat gun including an outer shroud defining an airflow chamber which terminates in a tubular distal end. A fan is disposed within the airflow chamber for driving the airflow and is powered by a motor. A plurality of heating coils are disposed within the airflow chamber and heat the airflow between 1200° and 1700° Fahrenheit. A fan-shaped attachment has a tubular nozzle cover which receives the tubular distal end of the outer shroud, wherein the tubular cover extends into a pair of sidewall surfaces terminating in an elongated port.

Objects of the invention are further achieved by a heat gun having an elongated port with a width between 1 and 3 inches in diameter and a length between 8 and 12 inches.

Moreover, objects of the invention are achieved by an attachment for a heat gun including a plurality of ribs connecting a pair of sidewall surfaces and extending longitudinally from a tubular nozzle to an elongated port to thereby define a plurality of longitudinal air passages which evenly distribute airflow along the fan-shaped attachment. Each of a portion of said plurality of ribs may optionally include an air stop at an end proximal to the tubular distal end such that air flow is restricted along the portion of the longitudinal air passages to promote efficient airflow distribution along the attachment.

The aforementioned and other objects, features, and advantages of the present invention will become readily apparent from the following description of the preferred embodiment(s), as well as from the associated drawings, all of which merely illustrate the inventive concept, and are not in any way intended, nor should they be construed, to limit the scope of the instant invention.

DETAILED DESCRIPTION OF THE PREFERRED EMBODIMENTS

Figure 1:
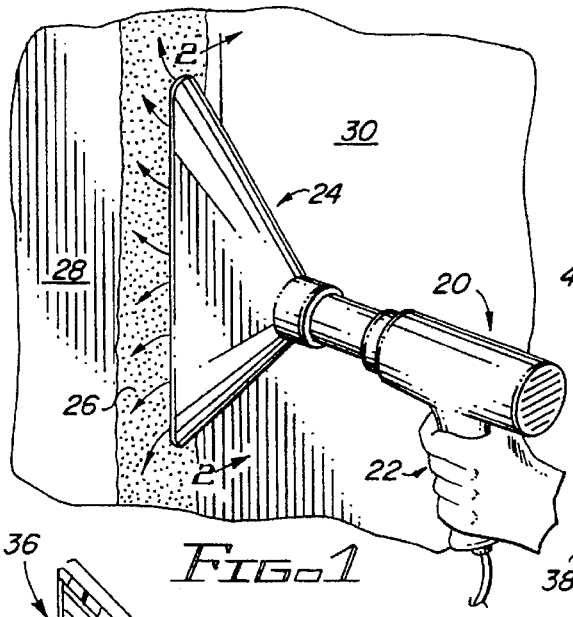
FIG. 1 is a perspective view of a heat gun for drying joint compound according to a preferred embodiment of the present invention.

With reference now to the drawings and more particularly to FIG. 1, heat gun 20 for drying joint compound is illustrated. Heat gun 20 is configured and arranged to be held with a single hand of operator 22. Fan-shaped attachment 24 is removably affixed about the distal end of heat gun 20. Fan-shaped attachment 24 disperses the air flow output from heat gun 20 such that it is evenly applied to joint seam 26. Joint seam 26 binds adjacent sections of drywall 28 and 30.

Heat gun 20 is preferably made from a pair of housing shells which are preferably made from high temperature plastic. The shells connect with each other through a tongue-in-groove fastening system and may be fastened with fasteners such as screws or rivets.

Figure 2:
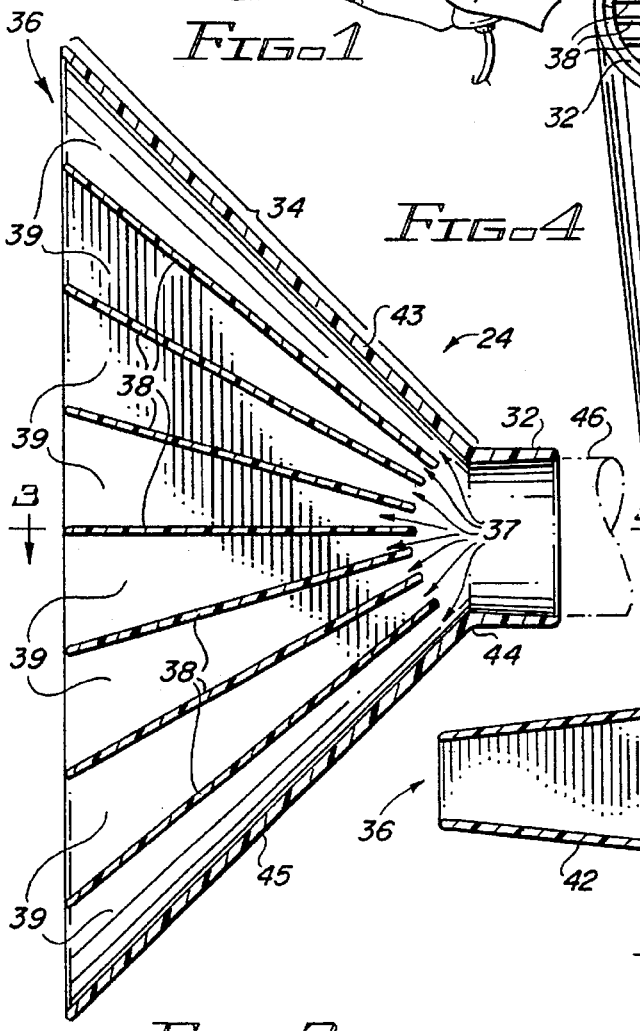
FIG. 2 is a cross sectional view of the heat gun illustrated in FIG. 1 taken along the line 2—2.
Figure 4:
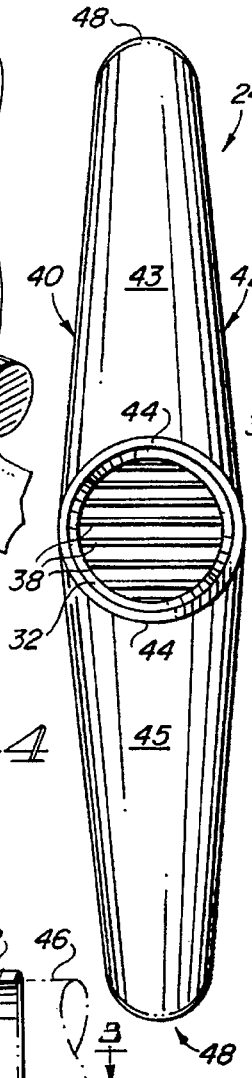
FIG. 4 is an elevated rear view of a fan-shaped attachment for a heat gun according to an embodiment of the present invention.

FIG. 2 illustrates a detailed sectional view of fan-shaped attachment 24. Fan-shaped attachment 24 includes nozzle cover 32 which is configured and arranged to slidably fit over endcap 46 of heat gun 20 by at least ½ inch. Nozzle cover 32 joins with expansion section 34 to provide a fluid path for the airflow output from heat gun 20. Expansion section 34 terminates in elongated port 36. Fan-shaped attachment 24, including ribs 38, is preferably made from metal to handle the high temperature air flow which is output therefrom. However, a high temperature thermoplastic material will also provide for proper operation of the present invention.

Referring now to FIGS. 2–5, fan-shaped attachment 24 is generally hollow with a plurality of ribs 38 disposed therein. Ribs 38 connect opposite sidewall surfaces 40 and 42 and cooperate with nozzle cover 32 to form an air inlet baffle having air inlets 37. As illustrated by the elevated rear view of FIG. 4, opposite sidewall surfaces 40 and 42 are substantially planar and converge toward elongated port 36 with an acute angle in an airflow direction. Sidewall surfaces 40 and 42 diverge apart from each other as they extend toward nozzle cover 32. Sidewall surfaces are formed continually with each other by a pair of curved sections 43 and 45 as illustrated. Sidewall surfaces 40 and 42 connect with nozzle cover 32 at junction 44. Nozzle cover 32 is relatively tubular such that fan-shaped attachment 24 snugly fits over endcap 46 of heat gun 20. Endcap 46 may optionally receive a variety of additional attachments for special applications.

Figure 5:
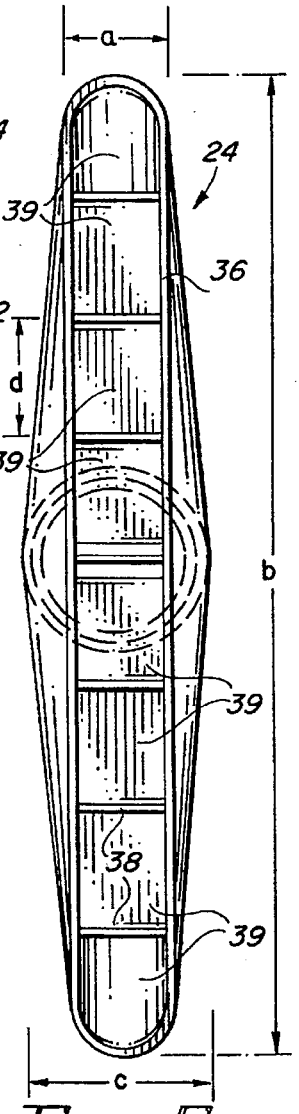
FIG. 5 is an elevated front view of the fan-shaped attachment illustrated in FIG. 4.
Figure 3:
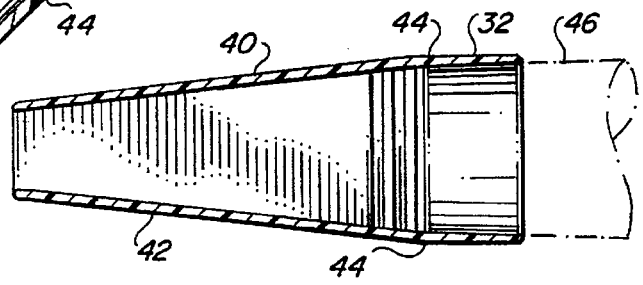
FIG. 3 is a cross sectional view of the heat gun illustrated in FIG. 2 taken along the line 3—3.

The inventor has discovered that the dimensions of the present invention are important for proper operation. Fiberglass tape is generally 2 inches in width and a typical joint seam varies between ⅛ inch and 1 inch. The finished joint is 10 to 12' in length. Further, one piece of fiberglass tape is generally used to secure adjacent sections of drywall. Accordingly, the configuration of a heat gun attachment designed for drying joint compound will require specific dimensions. With reference to FIG. 5, dimensions according to the following Table 1 will provide for operation of the present invention.

TABLE 1

| Dimension | Length in inches |
|---|---|
| a: width | ½–3 |
| b: length | 6–14 |
| c: nozzle diameter | 1–3 |
| d: rib separation | evenly spaced along dimension b |

With further reference to FIG. 5, dimensions according to the following Table 2 will provide for enhanced operation of the present invention.

TABLE 2

| Dimension | Length in inches |
|---|---|
| a: width | ½–2 |
| b: length | 8–12 |
| c: nozzle diameter | 1¾–2¼ |
| d: rib separation | evenly spaced along dimension b |

With even further reference to FIG. 5, dimensions according to the following Table 3 will provide for optimum operation of the present invention.

TABLE 3

| Dimension | Length in inches |
|---|---|
| a: width | ¾ |
| b: length | 10 |
| c: nozzle diameter | 2 |
| d: rib separation | evenly spaced along dimension b |

As a further matter, the ribs 38 and outer shroud of fan-shaped attachment 24 are preferably as small as possible and preferably less than ¼ inch. More preferably the ribs are ⅛ inch in diameter with a preferred thickness of 1/16 inch in diameter.

Fan-shaped attachment 24 includes a plurality of longitudinal air passages 39 which extend from nozzle cover 32 to elongated port 36, as illustrated.

Rounded corners 48 of fan-shaped attachment 24 are an important feature of the present invention. Rounded corners 48 reduce the potential for accidentally gouging the joint compound during drying thereof. Further, rounded corners 48 increase the visibility of the operator during drying of the joint compound. Rounded corners 48 are preferably semicircular in shape but may be elliptical. Further, rounded corners may be generally rectangular with the provision that the corners are rounded to reduce the potential of gouging the wet joint compound.

Figures 6, 7, 8:
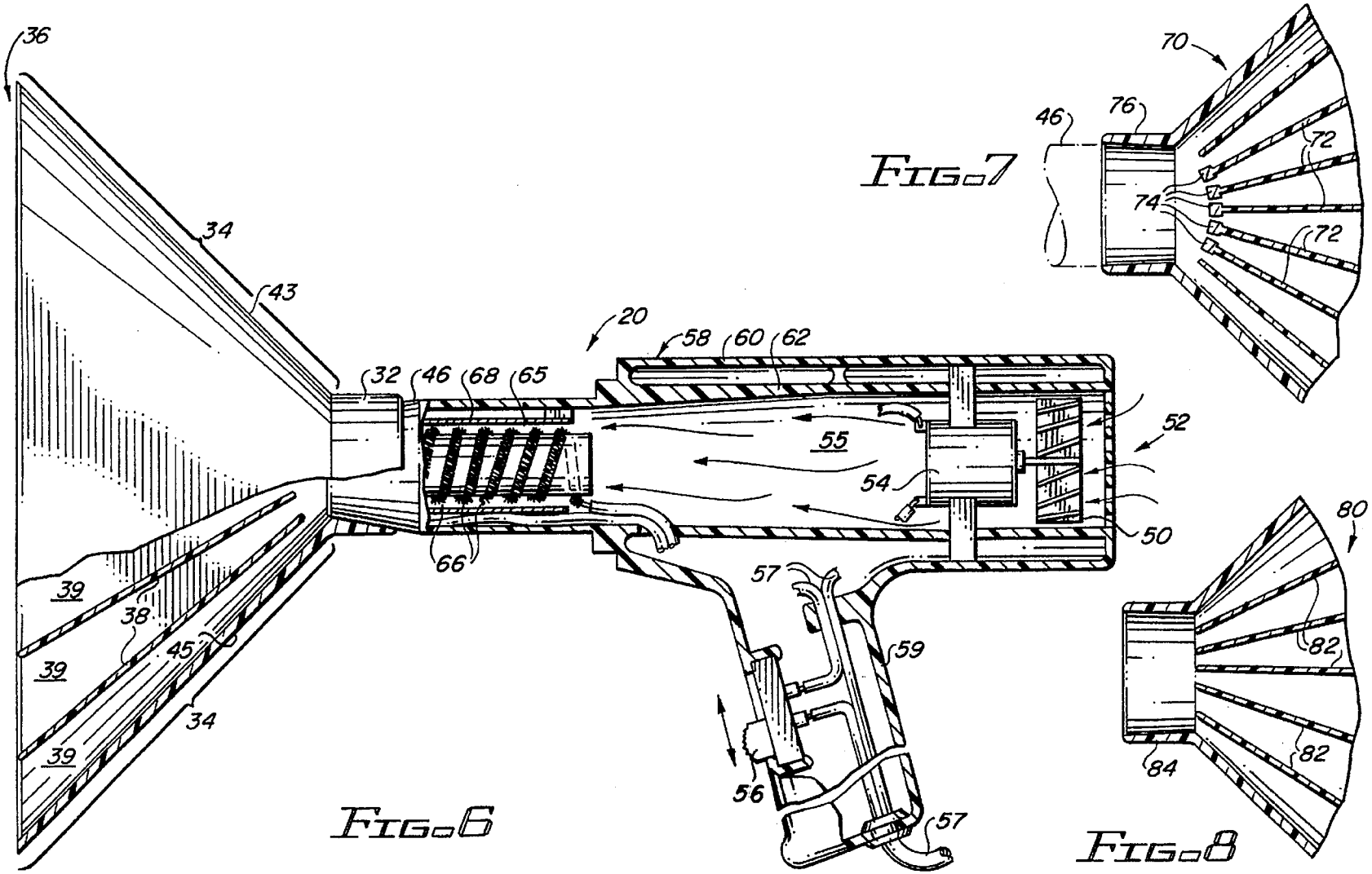
FIG. 6 is a partial sectional view of a heat gun for drying joint compound including a fan-shaped attachment according to an embodiment of the present invention.
FIG. 7 is a cross sectional view of the heat gun illustrated in FIG. 1 taken along the line 2—2 according to another embodiment of the present invention.
FIG. 8 is a cross sectional view of the heat gun illustrated in FIG. 1 taken along the line 2—2 according to yet another embodiment of the present invention.

FIG. 6 illustrates a sectional view of heat gun 20 according to an embodiment of the present invention. As illustrated, high speed impeller 50 includes a plurality of vanes which force air 52 into heat gun 20. High speed impeller 50 is driven by electric motor 54. Electric motor 54 is controlled by ON/OFF switch 56. ON/OFF switch 56 is disposed in pistol grip 59 of heat gun 20. ON/OFF switch 56 connects electrical cable 57 with electric motor 54 and heating coils 66. Electric motor 54 and high speed impeller 50 are permanently secured to outer shroud 58 of heat gun 20. Electric motor 54 and high speed impeller 50 are disposed along airflow chamber 55.

Outer shroud 58 includes outer section 60 and inner section 62 such that heat generated by the internal components of heat gun 20 does not significantly increase the outer temperature of heat gun 20. This adds to operator comfort and increases safety of the invention.

As further illustrated in FIG. 6, air flow 52 continues past heating section 65. Heating section 65 includes a plurality of heating coils 66. A small amount of air flow must pass across the top and bottom of heating coils 66 to promote cooling of the exterior of heat gun 20. Heating coils 66 heat air flow 52 to a desired temperature before application to the joint compound through fan-shaped attachment 24. Heating coils 66 are helically wound on a ceramic core located within a hollow cylindrical ceramic sleeve.

Heating coils 66 are separated from outer shroud 58 by heating coil insulating layer 68. Heating coil insulating layer is preferably a metal housing which surrounds heating coils 66. The temperature of airflow 52 output from heating gun 20 is important for proper operation of the invention. If the temperature of airflow 52 is not hot enough, the joint compound will not dry properly. On the other hand, if the temperature of airflow 52 is too hot, there is a potential fire hazard and the potential to cause heat damage to the paper face of the underlying drywall. Heating coils 66 preferably heat airflow 52 to a temperature of 1200° to 1700° Fahrenheit. A more preferable temperature is between 1400° and 1600° Fahrenheit with an optimum temperature of 1500° Fahrenheit.

Insulating layer 68 adds to operator comfort and increases safety of the invention when the operator is required to use two hands to operate heating gun 20. The operator may use two hands due to fatigue or to access a difficult section of joint compound.

As illustrated in FIG. 6, endcap 46 of heat gun 20 is tapered such that it may be received within nozzle cover 32 of fan-shaped attachment 24. As illustrated, heat gun 20 and fan-shaped attachment 24 are preferably formed in two separate parts to facilitate cleaning of the device.

FIG. 7 illustrates fan-shaped attachment 70 according to another embodiment of the present invention. Fan shaped attachment 70 includes nozzle cover 76. Nozzle cover 76 is tapered such that it receives endcap 46 of heat gun 20. According to this embodiment, fan-shaped attachment 70 includes a plurality of ribs 72 which have air stops 74 at ends thereof. Air stops 74 restrict airflow 52 through the center of fan-shaped attachment 70. According to this embodiment of the present invention, airflow is more evenly distributed between the ribs 72 and therefore more evenly distributed out of fan-shaped attachment 70.

FIG. 8 illustrates fan-shaped attachment 80 according to another embodiment of the present invention. Fan shaped attachment 80 includes nozzle cover 84. Nozzle cover 84 is tapered such that it receives an endcap of heat gun 20. According to this embodiment, fan-shaped attachment 80 includes a plurality of ribs 82 which extend to an interior end of nozzle cover 84. Ribs 82 disperse the airflow 52 which is transmitted through the center of fan-shaped attachment 80. According to this embodiment of the present invention, airflow is distributed between the ribs 82 and therefore evenly distributed out of fan-shaped attachment 80.

The foregoing is considered as illustrative only of the principles of the invention, and since numerous modifications and changes will readily occur to those skilled in the art, it is not desired to limit the invention to the exact construction and operation shown and described, and accordingly, all suitable modifications and equivalents may be resorted to, falling within the scope of the following claims.

I claim:

1. A heat gun for quickly drying joint compound comprising:

an outer shroud defining an airflow chamber which terminates in a tubular distal end;

a fan disposed within the airflow chamber for forcing airflow within the airflow chamber;

a motor disposed within the airflow chamber and providing drive to the fan;

a plurality of heating coils disposed within the airflow chamber and heating the airflow between 1400° and 1700° Fahrenheit; and a fan-shaped attachment having a tubular nozzle cover which is configured to receive the tubular distal end of the outer shroud, wherein the tubular cover extends into a pair of sidewall surfaces terminating in an elongated port.

2. The heat gun according to claim 1, wherein the elongated port has a width between ½ and 3 inches in diameter and a length between 6 and 14 inches.

3. The heat gun according to claim 2, wherein the elongated port has a width between ½ and 2 inches in diameter and a length between 8 and 12 inches.

4. The heat gun according to claim 3, wherein the elongated port has a width of ¾ inches in diameter and a length of 10 inches.

5. The heat gun according to claim 1, wherein the plurality of heating coils disposed within the airflow chamber heat the airflow between 1450° and 1600° Fahrenheit.

6. The heat gun according to claim 1, wherein the plurality of heating coils disposed within the airflow chamber heat the airflow to a temperature of 1500° Fahrenheit.

7. The heat gun according to claim 1, wherein the fan-shaped attachment comprises:

a plurality of ribs connecting the pair of sidewall surfaces and extending longitudinally from the tubular nozzle to the elongated port to thereby define a plurality of longitudinal air passages which evenly distribute airflow along the fan-shaped attachment.

8. The heat gun according to claim 7, wherein each of a portion of said plurality of ribs includes an air stop at an end proximal to the tubular distal end such that air flow is restricted along the longitudinal air passages disposed between said portion of the plurality of ribs.

9. A hand held heat gun for quickly drying joint compound comprising:

means for generating an airflow between 1500° and 1700° Fahrenheit;

a tubular nozzle cover which is so configured and arranged to receive the airflow, wherein said tubular nozzle cover defines an interior air passage which transmits the airflow therethrough; and a fan-shaped expansion section formed continuously with the tubular nozzle cover and defining an expansion section which receives the airflow from the tubular nozzle cover, wherein the expansion section extends into a pair of substantially planar sidewall surfaces formed with an acute angle in an airflow direction and the pair of sidewall surfaces are joined by a pair of curved sections.

10. The fan-shaped attachment for a heat gun according to claim 9, wherein the elongated port has a width between ½ and 3 inches in diameter and a length between 6 and 14 inches.

11. The fan-shaped attachment for a heat gun according to claim 10, wherein the elongated port has a width between ½ and 2 inches in diameter and a length between 8 and 12 inches.

12. The fan-shaped attachment for a heat gun according to claim 11, wherein the elongated port has a width of ¾ inches in diameter and a length of 10 inches.

13. The fan-shaped attachment for a heat gun according to claim 9, further comprising:

a plurality of ribs connecting the pair of sidewall surfaces and extending longitudinally from the tubular nozzle to the elongated port to thereby define a plurality of longitudinal air passages which evenly distribute airflow along the fan-shaped attachment.

14. The fan-shaped attachment for a heat gun according to claim 13, wherein each of a portion of said plurality of ribs includes an air stop at an end proximal to the tubular distal end such that air flow is restricted along the longitudinal air passages disposed between said portion of the plurality of ribs.

15. A method of applying joint compound comprising the steps of:

applying a first layer of wet joint compound to a surface; and setting the first layer of wet joint compound by applying an airflow between 1400° and 1700° Fahrenheit to the first layer of wet joint compound.

16. The method of applying joint compound according to claim 15, further comprising the steps of:

sanding the first layer of set joint compound;

applying a second layer of wet joint compound over the set first layer of joint compound; and setting the second layer of wet joint compound by applying an airflow between 1400° and 1700° Fahrenheit to the second layer of wet joint compound.

17. The method of applying joint compound according to claim 15, wherein the airflow is between 1450° and 1600° Fahrenheit.

18. The method of applying joint compound according to claim 15, wherein the airflow is approximately 1500° Fahrenheit.

19. The method of applying joint compound according to claim 15, wherein the airflow is applied with a heat gun including:

an outer shroud defining an airflow chamber which terminates in a tubular distal end;

a fan disposed within the airflow chamber for forcing airflow within the airflow chamber;

a motor disposed within the airflow chamber and providing drive to the fan;

a plurality of heating coils disposed within the airflow chamber which heat the airflow between 1400° and 1700° Fahrenheit; and a fan-shaped attachment having a tubular nozzle cover which is configured to receive the tubular distal end of the outer shroud, wherein the tubular cover extends into a pair of sidewall surfaces terminating in an elongated port.

20. The method of applying joint compound according to claim 15, wherein the airflow is applied with a hand held heat gun including:

means for generating an airflow between 1450° and 1600° Fahrenheit;

a tubular nozzle cover which is so configured and arranged to receive the airflow, wherein said tubular nozzle cover defines an interior air passage which transmits the airflow therethrough; and a fan-shaped expansion section formed continuously with the tubular nozzle cover and defining an expansion section which receives the airflow from the tubular nozzle cover, wherein the expansion section extends into a pair of substantially planar sidewall surfaces formed with an acute angle in an airflow direction and the pair of sidewall surfaces are joined by a pair of curved sections.

* * * * *